US009103090B2

(12) United States Patent
Bushore

(10) Patent No.: US 9,103,090 B2
(45) Date of Patent: Aug. 11, 2015

(54) METHODS AND APPARATUSES OF SUPPORTING AND BRACING A POLE

(71) Applicant: Kevin M. Bushore, Bonnyville (CA)

(72) Inventor: Kevin M. Bushore, Bonnyville (CA)

( * ) Notice: Subject to any disclaimer, the term of this patent is extended or adjusted under 35 U.S.C. 154(b) by 0 days.

(21) Appl. No.: 13/738,122

(22) Filed: Jan. 10, 2013

(65) Prior Publication Data

US 2014/0190093 A1 Jul. 10, 2014

(51) Int. Cl.

| | |
|---|---|
| ***E04H 12/20*** | (2006.01) |
| ***E02D 27/42*** | (2006.01) |
| *E04H 12/22* | (2006.01) |

(52) U.S. Cl.

CPC ..... *E02D 27/42* (2013.01); *E04H 12/20* (2013.01); *E04H 12/22* (2013.01); *E04H 12/2238* (2013.01)

(58) Field of Classification Search

CPC ..... E04H 12/20; E04H 12/22; E04H 12/2238; E04H 12/2284; E04H 17/00

USPC ..... 52/170, 146, 150, 149, 151, 152, 127.2, 52/127.1, 153, 154, 745.21, 155, 159, 160, 52/161; 248/15, 165, 164; 256/21

See application file for complete search history.

(56) References Cited

U.S. PATENT DOCUMENTS

| | | | | | |
|---|---|---|---|---|---|
| 213,932 | A | * | 4/1879 | Powell | 52/155 |
| 278,220 | A | * | 5/1883 | Carson | 256/21 |
| 492,520 | A | | 2/1893 | Hedges | |
| 645,372 | A | | 3/1900 | Paldi | |
| 658,779 | A | | 10/1900 | Huntress | |
| 724,644 | A | | 4/1903 | Winslow | |
| 785,270 | A | * | 3/1905 | Beams | 52/146 |
| 825,158 | A | | 7/1906 | Rousseau et al. | |
| 826,124 | A | * | 7/1906 | Soseman | 52/150 |
| 856,725 | A | | 6/1907 | Roach | |
| 866,303 | A | * | 9/1907 | Reynolds | 52/152 |
| 877,268 | A | * | 1/1908 | Buren | 52/165 |
| 903,686 | A | * | 11/1908 | Devany | 52/150 |
| 925,940 | A | | 6/1909 | McClintock | |
| 931,425 | A | | 8/1909 | Hile | |
| 1,271,751 | A | * | 7/1918 | Novess | 52/150 |
| 1,679,297 | A | | 1/1928 | Ehrler | |
| 1,690,955 | A | * | 11/1928 | Stoufflet | 52/149 |
| 1,719,352 | A | * | 7/1929 | Young | 52/149 |
| 1,722,352 | A | | 7/1929 | Rawley | |
| 1,811,217 | A | * | 6/1931 | Spaugh | 52/151 |
| 1,984,767 | A | * | 12/1934 | Shaffert | 52/648.1 |
| 2,510,717 | A | * | 6/1950 | Roos | 269/46 |
| 2,653,688 | A | | 9/1953 | Gordon | |
| 2,903,856 | A | | 9/1959 | Dean | |
| 3,027,686 | A | * | 4/1962 | Oates | 52/127.2 |

(Continued)

OTHER PUBLICATIONS

"Week 13: Distribution: Equipment", Electrical Power Plant Design [online], Jul. 2012, http://engr.freeservers.com/ppd/d/302.html.

(Continued)

*Primary Examiner* — Phi A

(74) *Attorney, Agent, or Firm* — Buchanan Nipper

(57) ABSTRACT

An apparatus comprising: a pole erected relative to a ground surface and defining a pole axis; a first anchor drive rod connected to the pole and extended, parallel to the pole axis, from the pole to below the ground surface; and a second anchor drive rod connected to the pole and extended, at a non zero angle to the pole axis, from the pole to below the ground surface. Methods of bracing and supporting the pole are also discussed.

8 Claims, 4 Drawing Sheets

(56) References Cited

U.S. PATENT DOCUMENTS

| | | | | | |
|---|---|---|---|---|---|
| 3,546,885 | A | * | 12/1970 | Pogonowski | 405/227 |
| 3,809,346 | A | * | 5/1974 | Jackson | 248/530 |
| 3,874,625 | A | * | 4/1975 | Hansen et al. | 248/354.5 |
| 4,068,427 | A | * | 1/1978 | Camardo | 52/127.2 |
| 4,074,481 | A | * | 2/1978 | Lang et al. | 52/169.8 |
| 4,083,156 | A | * | 4/1978 | Tye | 248/354.5 |
| 4,242,822 | A | * | 1/1981 | Black | 40/607.06 |
| 4,268,066 | A | * | 5/1981 | Davis | 280/763.1 |
| 4,327,534 | A | * | 5/1982 | Mastalski et al. | 52/122.1 |
| 4,455,795 | A | * | 6/1984 | Cole | 52/155 |
| 4,889,322 | A | * | 12/1989 | Wagner | 256/36 |
| 5,038,536 | A | * | 8/1991 | De Mendoza Sans | 52/146 |
| 5,042,780 | A | * | 8/1991 | Yearwood | 256/36 |
| 5,233,809 | A | * | 8/1993 | Gropper | 52/150 |
| 5,253,839 | A | * | 10/1993 | McClure | 248/354.1 |
| 5,291,709 | A | | 3/1994 | Vranjesevic | |
| 5,317,844 | A | * | 6/1994 | Legler | 52/155 |
| 5,343,667 | A | * | 9/1994 | Peden | 52/699 |
| 5,356,101 | A | | 10/1994 | Malloy | |
| 5,564,235 | A | * | 10/1996 | Butler | 52/126.6 |
| 5,704,171 | A | * | 1/1998 | Ruff et al. | 52/127.2 |
| 5,791,635 | A | | 8/1998 | Hull et al. | |
| 6,112,475 | A | * | 9/2000 | Truitt | 52/127.2 |
| 6,230,449 | B1 | | 5/2001 | Colvin, Jr. | |
| 6,298,618 | B1 | | 10/2001 | Lawson | |
| 6,419,201 | B1 | | 7/2002 | Hughes, Jr. et al. | |
| 6,439,344 | B1 | * | 8/2002 | Cole | 182/113 |
| 6,655,097 | B1 | * | 12/2003 | Poolaw | 52/127.2 |
| 6,684,580 | B1 | * | 2/2004 | Hull | 52/170 |
| 6,931,805 | B2 | * | 8/2005 | Gregory et al. | 52/296 |
| 6,976,339 | B1 | * | 12/2005 | Riccio et al. | 52/127.1 |
| 6,986,495 | B2 | * | 1/2006 | Pinkleton et al. | 248/507 |
| 7,040,059 | B2 | * | 5/2006 | Hodsdon et al. | 52/127.2 |
| 7,059,095 | B1 | | 6/2006 | Stevens et al. | |
| 7,073,296 | B2 | * | 7/2006 | Gregory et al. | 52/157 |
| 7,434,361 | B1 | * | 10/2008 | Taylor | 52/127.2 |
| 7,665,252 | B2 | * | 2/2010 | Lang | 52/127.2 |
| 7,739,842 | B1 | * | 6/2010 | Hodsdon et al. | 52/127.2 |
| 7,913,463 | B2 | | 3/2011 | Russell | |
| 7,993,107 | B2 | * | 8/2011 | Gevers | 416/244 R |
| 8,322,106 | B2 | * | 12/2012 | Simmons | 52/652.1 |
| 2001/0045079 | A1 | * | 11/2001 | Nichols | 52/749.14 |
| 2002/0073634 | A1 | * | 6/2002 | Bolinger et al. | 52/127.2 |
| 2002/0088187 | A1 | * | 7/2002 | Howard et al. | 52/162 |
| 2003/0015633 | A1 | * | 1/2003 | Pyanowski et al. | 248/146 |
| 2005/0072066 | A1 | * | 4/2005 | Leslie | 52/127.2 |
| 2006/0207215 | A1 | * | 9/2006 | Bruno | 52/745.12 |
| 2007/0084137 | A1 | * | 4/2007 | Pasto | 52/170 |
| 2007/0175174 | A1 | * | 8/2007 | Bruno | 52/745.12 |
| 2008/0141598 | A1 | * | 6/2008 | Cook | 52/127.2 |
| 2008/0202043 | A1 | * | 8/2008 | Marshall et al. | 52/127.2 |
| 2010/0218438 | A1 | * | 9/2010 | Sollars | 52/127.2 |
| 2011/0047895 | A1 | * | 3/2011 | Finch | 52/126.1 |
| 2012/0096778 | A1 | * | 4/2012 | Bauletti | 52/155 |

OTHER PUBLICATIONS

"Utility Industry Anchor Design and Maintenance Manual", Earth Contact Products LLC, Jun. 2011.

"Helical Light Pole Foundations", ECP Utility [online], Oct. 2012, http://www.ecputility.com/Light_Pole_Foundations.asp.

"Pole Clip", Hubbell Power Systems, Inc. [online], Oct. 2012, http://www.hubbellpowersystems.com/anchoring/pole-support/pole-clip.

"Foundation Anchors", Pelco Utility Products Inc., Jul. 2006.

* cited by examiner

METHODS AND APPARATUSES OF SUPPORTING AND BRACING A POLE

TECHNICAL FIELD

This document relates to methods and apparatuses of supporting and bracing a pole.

BACKGROUND

Utility poles are used to support overhead power lines and other public utilities. Traditional methods of supporting a utility pole include using one or more guy wires to laterally brace the pole in the vertical position. In some environments, such as soft soils, guy wires may be ineffective in bracing utility poles. Over time, wind loading on insufficiently braced poles may cause pole tipping, resulting in the weight of the conductor failing the line.

SUMMARY

A method is disclosed of supporting a pole that is erected relative to a ground surface and defines a pole axis, the method comprising: inserting a first anchor drive rod and a second anchor drive rod below the ground surface; and connecting each of the first anchor drive rod and the second anchor drive rod to the pole; in which the first anchor drive rod is parallel to the pole axis and the second anchor drive rod is at a non zero angle to the pole axis.

A method is disclosed of bracing a pole that is erected relative to a ground surface and defines a pole axis, in which a first anchor drive rod is connected to the pole and extended below the ground surface parallel to the pole axis, the method comprising: inserting a second anchor drive rod below the ground surface at a non zero angle to the pole axis; and connecting the second anchor drive rod to the pole.

An apparatus is disclosed comprising: a pole erected relative to a ground surface and defining a pole axis; a first anchor drive rod connected to the pole and extended, parallel to the pole axis, from the pole to below the ground surface; and a second anchor drive rod connected to the pole and extended, at a non zero angle to the pole axis, from the pole to below the ground surface.

In various embodiments, there may be included any one or more of the following features: The first anchor drive rod and the second anchor drive rod are both foundation anchors sized for the pole. The first anchor drive rod and the second anchor drive rod are helical piers. Inserting comprises screwing. Inserting comprises monitoring torque applied to the second anchor drive rod during insertion and stopping insertion after the torque applied exceeds a predetermined value. Connecting comprises connecting the second anchor drive rod to the pole through a bracket. The soil adjacent the pole is unstable soil. The unstable soil is one or more of permafrost, soils with ice lensing, muskeg, soil with organics, water saturated soils, silts, clay, peat, hog fuel, wood chips, and weak alluvial soils. The second anchor drive rod is connected at a vertical connection distance from the ground surface and at an angle with respect to the pole sufficient to laterally brace the upper end of the pole. The method may include erecting the pole relative to the ground surface. The first anchor drive rod is connected adjacent to a base of the pole. Connecting further comprises connecting the second anchor drive rod to restrict relative movement, in all axes of direction, between the pole and the second anchor drive. A bracket connects the second anchor rod and the pole. The bracket has a guide, and the bracket has at least a configuration in which the guide allows relative axial displacement between the bracket and the second anchor drive rod. The pole is a utility pole.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
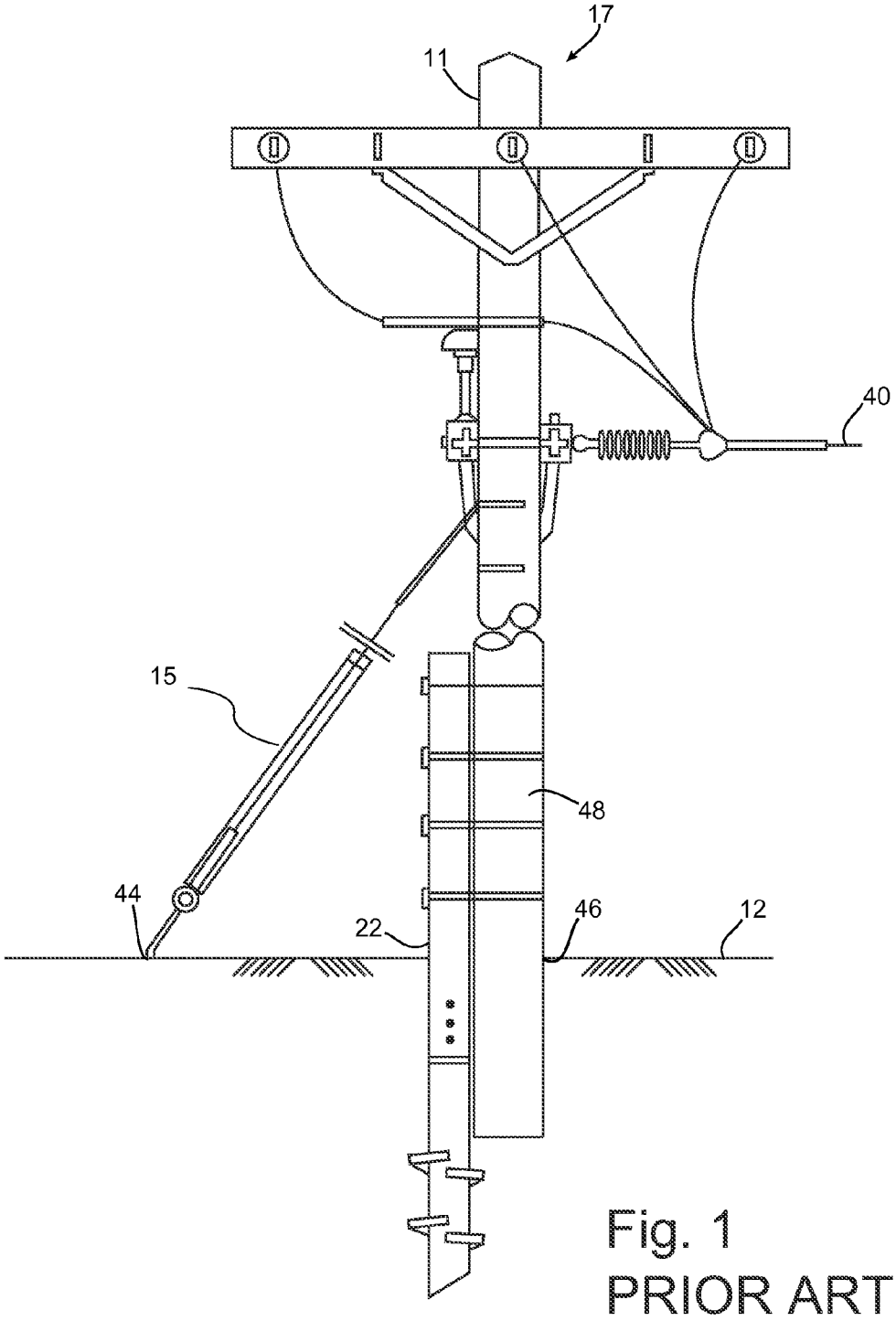
Fig. 1 PRIOR ART
FIG. 1 is a side view of a known method of supporting a utility pole with a foundation anchor and guy wire.

Referring to FIG. 1, utility poles 11 are used to support overhead power lines 40 and various other public utilities, such as cable, fiber optic cable, and related equipment such as transformers and street lights. Utility poles may be referred to as telephone, power, hydro, telegraph, or telegraph posts or poles, depending on application. Electrical cable may be routed overhead as an inexpensive way to keep it insulated from the ground 12 and out of the way of people and vehicles. Utility poles may be made of wood, metal, concrete, composites like fiberglass, or other suitable materials.

FIG. 1 shows a depiction of a pole 11. Pole 11 may extend below ground surface 12, but is founded by a foundation anchor, such as a helical pier 22. Pier 22 is driven into ground surface 12 adjacent and parallel to pole 11, and secured to a base 48 of pole 11. An upper end 17 of pole 11 may be laterally braced using one or more guy wires 15, which are anchored below ground surface 12 at guy insertion points 44 spaced a sufficient lateral distance from a pole entry point 46 in ground surface 12. Although shown in a 60-90 degree cable installation, guy wires are similarly used in other pole 11 cable installations, such as tangent or dead end cable installations.

Figure 2:
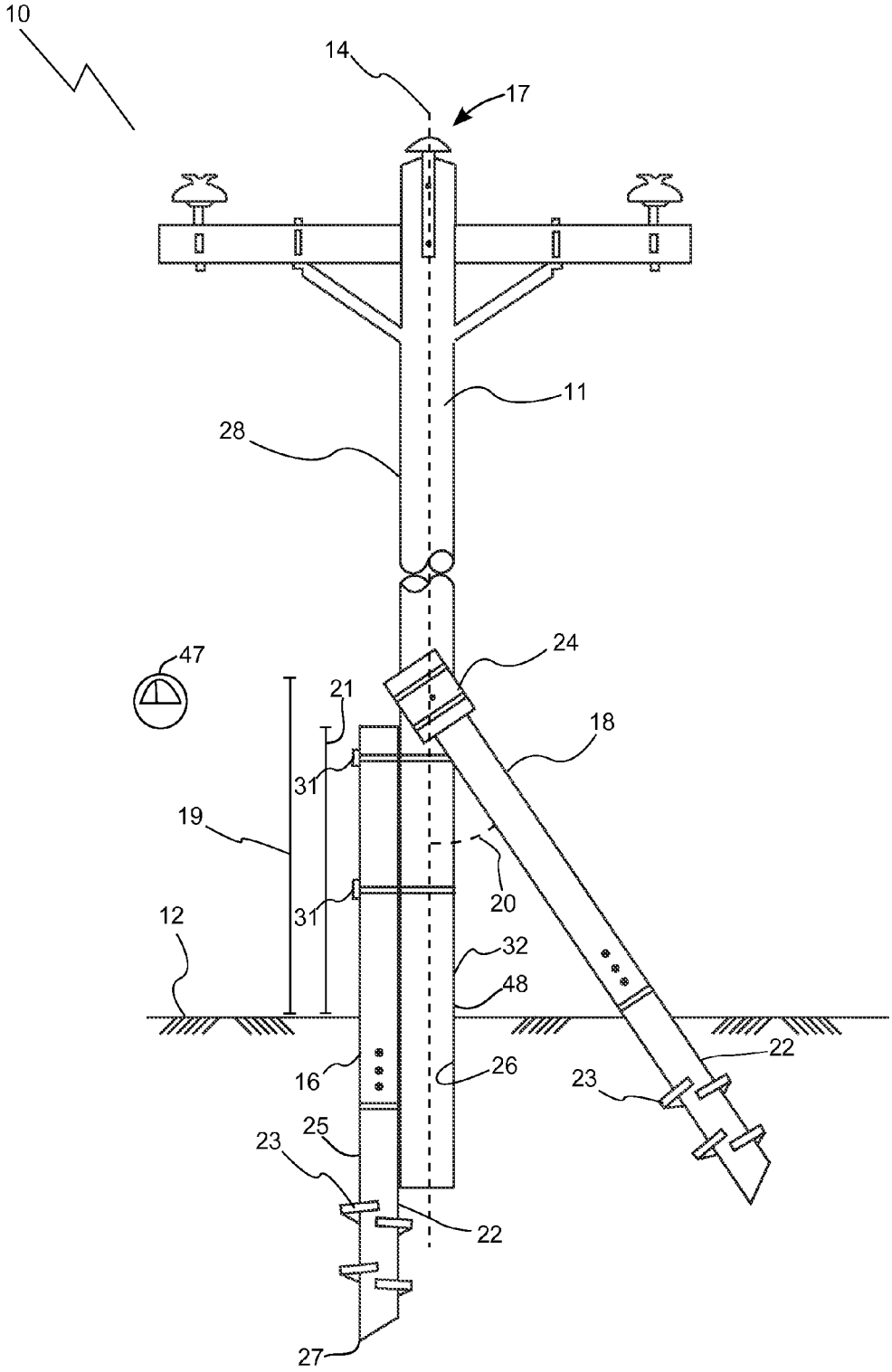
FIG. 2 is a side view illustrating a system and method of supporting or bracing a pole.

As seen in FIG. 2, in particular embodiments, an apparatus 10 is illustrated. Apparatus 10 may include a pole 11, a first anchor drive rod 16, and a second anchor drive rod 18. Pole 11 may be erected relative to a ground surface 12 to define a pole axis 14. The first anchor drive rod 16 may be connected to the pole 11, for example using a suitable securing mechanism like a series of bolts 31. Rod 16 may also be extended, parallel to the pole axis 14, from the pole 11 to below the ground surface 12 as shown. The second drive rod 18 may be connected to the pole 11, for example using a suitable securing mechanism like a bracket 24. Rod 18 may be extended, at a non zero angle 20 to the pole axis 14, from pole 11 to below the ground surface 12 as shown.

The use of the second anchor drive rod 18 may give tensile lateral support to the pole 11 like a guy wire, but also gives compression support to the pole 11. The first anchor drive rod 16 and the second anchor drive rod 18 may both be foundation anchors sized for the pole 11 as shown. In other words, even though drive rod 16 is illustrated as founding the pole, drive rod 18 is also of sufficient dimensions and strength to found the pole 11 by occupying the founding position of drive rod 16. This means the same equipment can be used to install both anchor rods 16 and 18. Using one or more foundation anchors as rod 18 is advantageous because foundation anchors are cheaper and more efficient to install than are guy wires. By contrast, installing guy anchors requires on site welding and use of specialized tools as well as the cost of the guy anchor and wire itself.

In some embodiments, the first anchor drive rod 16 and the second anchor drive rod 18 may be helical piers 22 as shown. Helical piers 22 may comprise one or more helical flights 23 protruding laterally from a pier column 25. Pier 22 may also have pointed drive end 27. Using rod 18 may also eliminates the need for guying the pole 11 at all. Elimination of guying is advantageous for reasons given above and because guy wires give the pole 11 a larger lateral footprint than do rods 18. A smaller footprint is particularly useful if space around pole 11 is restricted, for example if located adjacent roadways, pipelines, or thick vegetation.

Figure 3:
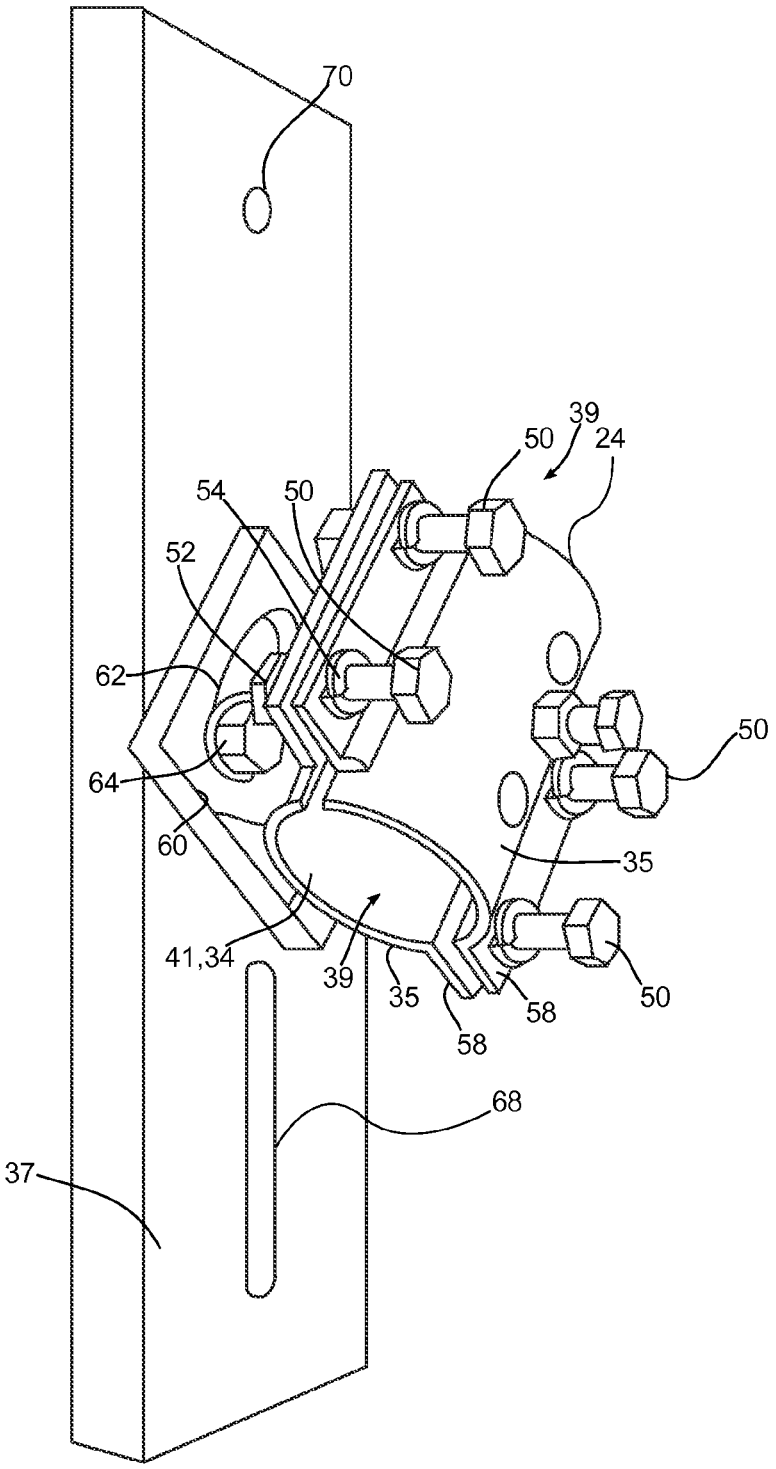
FIG. 3 is a perspective view of a bracket used in the method of FIG. 1.
Figure 4:
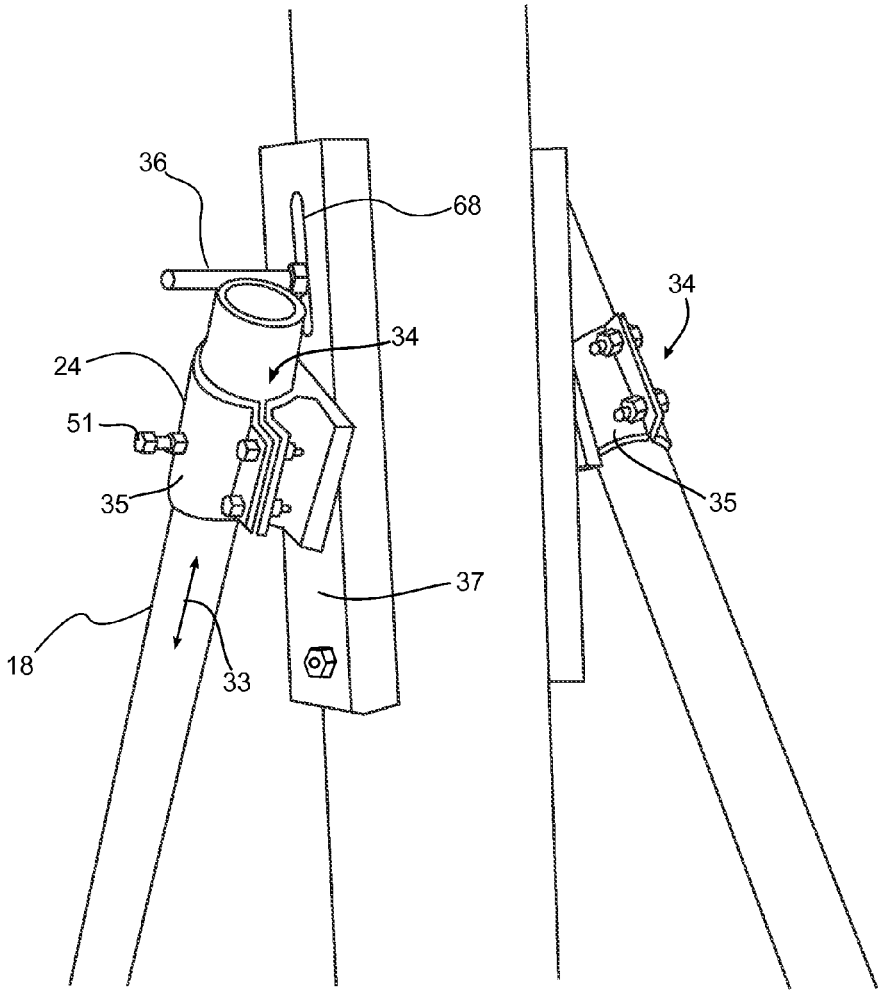
FIG. 4 is a perspective view of a pair of the brackets of FIG. 3 connected to the pole of FIG. 1 and each supporting an anchor drive rod.

As shown in FIGS. 3-6, the apparatus may comprise a bracket 24 connecting the second anchor rod 18 and the pole 11. The bracket 24 may be designed to withstand forces greater than the breaking strength of the pole 11. Bracket 24 may be formed of one or more parts, for example anchor mounts 35 and a pole mounting plate 37. Mounts 35, which may be semi cylindrical as shown, may form a guide, for example an axial passageway 41 sized to fit rod 18 and open at both axial ends 39 (FIGS. 3-4). Passageway 41 allows the bracket 24 to have at least a configuration in which the guide 34 allows relative axial displacement between the bracket 24 and the second anchor drive rod 18. In other words, rod 18 may be axially displaced through bracket 24 along direction lines 33 as shown in FIG. 4. Anchor mounts 35 may be connected together by a suitable mechanism, for example bolts 50, nuts 52, and spring clips 54, passing through cooperating flanges 58 as shown (FIG. 3). A further bolt 51 may be used to contact and secure rod 18 from axial movement once properly positioned within bracket 24 (FIG. 4).

Figure 5:
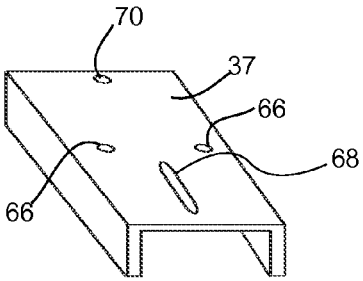
FIG. 5 is a perspective view of a pole mounting plate taken from the bracket of FIG. 3.
Figure 6:
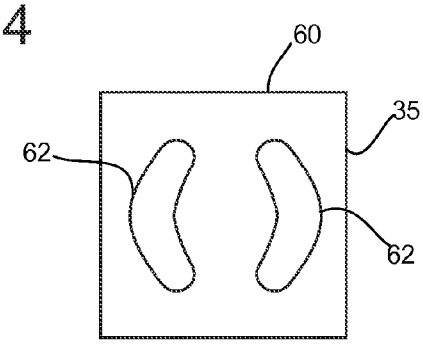
FIG. 6 is bottom plan view of the bracket of FIG. 3.

One of anchor mounts 35 may define a base, such as a base flange 60, for securing to pole mount 37 in use (FIGS. 3 and 6). Base flange 60 and pole mount 37 may be adapted to pivot or move relative to one another while partially secured together. For example, base flange 60 may include one or more C-shaped holes 62 that allow one or more bolts 64 to loosely secure to pole mount 37 through bolt holes 66, allowing bracket 24 to pivot (FIGS. 3, and 5-6). Pole mount 37 may also be designed to allow relative movement with pole 11 once partially secured to pole 11. For example, mount 37 may include a pair of holes, one being a slide hole 68 and the other being a standard bolt hole 70 (FIGS. 3 and 5). Once a bolt 36 is loosely passed through slide hole 68 into pole 11, bracket 24 may be vertically moved relative to pole 11 as far as permitted by the dimensions of slide hole 68. Once in position, bolts 36, 72, 64, and 51 may be fully secured to prevent further relative movement. These and other mechanisms may be used to allow relative movement between bracket 24 and pole 11 or bracket 24 and rod 18 to allow fine positional adjustments after rough positioning and partial securing. Allowing relative movement between pole 11 and bracket 24 makes installation of apparatus 10 more convenient. For example, if anchor rod 18 is driven into ground surface 12 first, and then bracket 24 installed partially upon pole 11, slide hole 68 and bolt 36 allow the proper vertical height of bracket 24 to be obtained after partially securing to pole 11. Similarly, holes 62 allow bracket 24 to assume the proper angle for receiving rod 18 and connecting to pole mount 37.

Referring to FIG. 2, a method of supporting a pole 11 is also illustrated. The method may begin with pole 11 being erected relative to a ground surface 12 and defining a pole axis 14. In a first stage, a first anchor drive rod 16 and a second anchor drive rod 18 may be inserted, for example by screwing, below the ground surface 12. In a second stage, each of the first anchor drive rod 16 and the second anchor drive rod 18 may be connected to the pole 11. After connection, the first anchor drive rod 16 may be parallel to the pole axis 14 and the second anchor drive rod 18 may be at a non zero angle 20 to the pole axis 14.

As described above inserting may further comprise screwing, for example if helical piers 22 are used. Screwing may be beneficial because it minimally disrupts the ground and thus negates the need to allow the ground to settle after installation. When working with unstable soils, the ability to avoid excavation and backfilling followed by settling is further advantageous, as the strength of the soil is already weak to begin with. Inserting may further comprise monitoring torque applied to the second anchor drive rod 18 during insertion and stopping insertion after the torque applied exceeds a predetermined value. The torque may be monitored directly, through for example a torque gauge 47, or indirectly, for example by counting the number of rotations. An exemplary predetermined torque value may be 1000 foot pounds averaged over 3 feet, although other suitable torques may be used depending on application. Monitoring torque gives a user an objective way to measure the holding strength of the rod 18. By comparison, there is no way of testing the holding strength of a guy anchor once installed, despite the requirement in many jurisdictions that holding strength must be of a predetermined value. Also, inserting rod 18 to a predetermined torque means that soil strength will not be a factor because the pull out strength is determined by the applied torque. If soils become too weak to meet the predetermined torque value, extension rod sections can be added to rod 18 to increase the length of rod 18 so that enough rod 18 can be inserted into ground 12 to meet the predetermined torque value. As shown in FIGS. 2-5, in particular embodiments, connecting may further comprise connecting the second anchor drive rod to the pole through a bracket 24. In other embodiments, inserting may comprise extending or pounding. An insertion hole (not shown) may be drilled prior to insertion of either rods 16 or 18.

The pole 11 may itself be inserted into the ground 12, or may be positioned on top of or above the ground 12. In some embodiments, either the first anchor drive rod 16 or the second anchor drive rod 18 or both may connect to the pole 11 above ground 12. In other embodiments the first anchor drive rod 16 or the second anchor drive rod 18 or both may connect to the pole 11 below ground 12.

The soil 26 adjacent to the pole 11 may be unstable soil 26, such as one or more of permafrost, soils with ice lensing, muskeg, soil with organics, water saturated soils, silts, clay, peat, hog fuel, wood chips, and weak alluvial soils. Soil strength may be determined using a geotechnical analysis, for example incorporating a standard penetration test.

Referring to FIG. 2, the second anchor drive rod 18 may be connected at a vertical connection distance 19 from the ground surface 12 and at an angle 20 with respect to the pole sufficient to laterally brace the upper end 17 of the pole. For example distance 19 may be 1-2 meters above ground, although other distances 19 may be used. Vertical connection distance 19 may be positioned above base height 21 of drive rod 16 in some cases. For example, angle 20 may be 30-60 degrees, although other angles may be used.

The method may further comprise erecting pole 11 relative to the ground surface 12, for example before, during, or after the first stage and before or during the second stage. In some embodiments, the first anchor drive rod 16 may be connected adjacent to a base 48 of the pole 32. In an exemplary embodiment, connecting may further comprise connecting the second anchor drive rod 18 to restrict relative movement, in all axes of direction, between the pole 11 and the second anchor drive rod 18.

In another embodiment, a pole 11 may be braced, the pole 11 already having a first anchor drive rod 16 connected to the pole 11 and extended below the ground surface parallel to the pole axis 14. Second anchor drive rod 18 may be inserted below the ground surface 12 at a non-zero angle 20 to the pole axis 14. The second anchor drive rod 18 may then be connected to the pole 11. Such a method allows existing installations comprising pole 11 founded by rod 16 to be improved via installation of rod 18 in the manner described. Such a method may be used to laterally brace pole installations in areas of unstable soils.

All of the methods disclosed here may be used for permanent or temporary installation of rods 16 and 18 to brace pole 11. One or both of rod 16 or 18 may be telescopic. The first and second anchor rods 16 and 18, respectively, may be inserted at the same time or in a suitable order of insertion. Rods 16 and 18 may be connected to the pole 11 at the same time or in a suitable order of connection. The pole 11 may be installed after one or both of rods 16 and 18 are inserted. The position of rod 16 as being parallel to the pole 11 includes at least nominal deviations from parallel. In some cases rod 16 need not be parallel, and may be at a non-zero angle relative to the pole axis. Use of rods 16 and 18 restricts lateral pole tipping as well as vertical jacking. The apparatus 10 may be designed to withstand a lateral force greater than the breaking strength of the pole 11. The first anchor drive rod 16 may be positioned underneath the pole 11 as a foundation base. Wherever mechanisms such as bolts or other securing mechanisms are discussed, it should be understood that other suitable connection mechanisms may be used, for example welding, nailing, adhesive, and others. Although described above with respect to a utility pole, other poles may be used in the apparatuses and methods disclosed here. Rod 18 may in some cases be installed through a bracket 24 after bracket 24 is partially secured to pole 11. Apparatus 10 in FIG. 2 is set up for a tangent installation relative to the conductor wire, although other installations may be used In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of bracing a utility pole that is erected relative to a ground surface and defines a utility pole axis, the method comprising:

inserting, by screwing in, an anchor drive rod below the ground surface at a non zero angle to the utility pole axis, in which the anchor drive rod is a helical pier comprising a screw, in which screwing in further comprises monitoring torque applied to the anchor drive rod during insertion and continuing insertion until the torque applied exceeds a predetermined minimum value;

mounting a bracket on the utility pole at a base of the utility pole but at a position above the ground surface, the bracket being formed of a plate and a clamp secured to the plate for rotation relative to the plate, the clamp having cooperating anchor receiving parts collectively defining a passageway for receiving a portion of the anchor drive rod, the bracket being mounted on the utility pole by bolting the plate to the utility pole;

rotating the clamp relative to the plate to align the passageway with the portion of the anchor drive rod;

positioning the portion of the anchor drive rod within the passageway; and clamping the portion within the passageway by securing the cooperating anchor receiving parts together with fasteners;

in which a portion of the utility pole is embedded within unstable soil below the ground surface, and the unstable soil is one or more of permafrost, soils with ice lensing, muskeg, soil with organics, water saturated soils, silts, peat, hog fuel, wood chips, and weak alluvial soils;

in which the predetermined minimum value of torque applied to the anchor drive rod is selected to be sufficient to laterally brace the upper end of the utility pole;

in which a first anchor drive rod is connected to the utility pole and extended below the ground surface parallel to the utility pole axis, the first anchor drive rod being connected at the base of the utility pole at a position above the ground surface.

2. The method of claim 1 in which the helical pier is sized for the utility pole.

3. The method of claim 1 further comprising erecting the utility pole relative to the ground surface.

4. The method of claim 1 in which the portion of the anchor drive rod is clamped against relative movement in all axes of direction, between the utility pole and the anchor drive rod.

5. The method of claim 1 in which the clamp is secured to the plate for rotation relative to the plate by a fastener passed through at least one aligned pair of openings in the plate and a base flange of the clamp, one of the openings in the aligned pair of openings having a C-shape.

6. The method of claim 1 in which the plate forms a channel that faces the utility pole when mounted, the channel forming a C-shape in cross-section.

7. A method of supporting a utility pole that is erected relative to a ground surface and defines a utility pole axis, the method comprising:

inserting, by screwing in, an anchor drive rod below the ground surface at a non-zero angle to the utility pole axis, in which the anchor drive rod is a helical pier comprising a screw, in which screwing in further comprises monitoring torque applied to the anchor drive rod during insertion and continuing insertion until the torque applied exceeds a predetermined minimum value;

mounting a bracket on the utility pole at a base of the utility pole but at a position above the ground surface, the bracket being formed of a plate and a clamp secured to the plate for rotation relative to the plate, the clamp having cooperating anchor receiving parts with laterally extending flanges, the flanges having openings for receiving fasteners, the cooperating anchor receiving parts each forming a C-shape in cross-section and collectively defining in use a passageway that is open at both ends and for receiving a portion of the anchor drive rod, the bracket being mounted on the utility pole by bolting the plate to the utility pole;

rotating the clamp relative to the plate to align the passageway with the portion of the anchor drive rod;

securing the clamp against relative rotation with the plate by tightening a fastener passed between aligned openings in the plate and a base flange of the clamp;

positioning the portion of the anchor drive rod within the passageway, in which respective pairs of openings in adjacent laterally extending flanges are aligned; and clamping the portion within the passageway by securing the cooperating anchor receiving parts together with fasteners passed through the respective pairs of openings in adjacent laterally extending flanges;

in which a portion of the utility pole is embedded within unstable soil below the ground surface and the unstable soil is one or more of permafrost, soils with ice lensing, muskeg, soil with organics, water saturated soils, silts, peat, hog fuel, wood chips, and weak alluvial soils; and in which the predetermined minimum value of torque applied to the anchor drive rod is selected to be sufficient to laterally brace the upper end of the utility pole.

8. The method of claim 7 in which the plate forms a channel that faces the utility pole when mounted, the channel forming a C-shape in cross-section.

* * * * *